US005600333A

United States Patent [19]

Justice et al.

[11] Patent Number: 5,600,333

[45] Date of Patent: Feb. 4, 1997

[54] ACTIVE REPEATER ANTENNA ASSEMBLY

[75] Inventors: Douglas W. Justice, Wilsonville, Oreg.; Damon L. Patton, Vancouver, Wash.

[73] Assignee: Larsen Electronics, Inc., Vancouver, Wash.

[21] Appl. No.: 379,690

[22] Filed: Jan. 26, 1995

[51] Int. Cl.[6] ..... H01Q 1/32

[52] U.S. Cl. ..... 343/713; 343/715

[58] Field of Search ..... 343/713, 715, 343/700 MS File, 711, 712, 725, 729, 853; 455/89, 90; H01Q 1/32

[56] References Cited

U.S. PATENT DOCUMENTS

| | | | |
|---|---|---|---|
| 2,026,652 | 1/1936 | Ponte | 343/848 |
| 2,206,820 | 12/1938 | Mydlil | 343/745 |
| 2,559,613 | 3/1946 | Halstead | 343/720 |
| 3,364,487 | 1/1968 | Maheux | 343/702 |
| 3,657,652 | 4/1972 | Smith | 343/720 |
| 4,001,834 | 1/1977 | Smith | 343/754 |
| 4,028,704 | 6/1977 | Blass | 343/715 |
| 4,089,817 | 5/1978 | Kirkendall | 343/713 |

(List continued on next page.)

FOREIGN PATENT DOCUMENTS

| | | |
|---|---|---|
| 458592 | 11/1991 | European Pat. Off. . |
| 3537107 | 4/1987 | Germany . |
| 64-36128 | 2/1989 | Japan . |
| 62-332720 | 3/1989 | Japan . |
| 6303016 | 10/1994 | Japan ..... H01Q 1/24 |

OTHER PUBLICATIONS

AARL Handbook for Radio Amateurs, American Radio Relay League, 1991. Ed. 68, pp. 28–34.

Fink, Electronics Engineers' Handbook, McGraw–Hill Book Company, 1st Ed., 1975, p. 3–3.

Johnson, Transmission Lines and Networks, McGraw–Hill Book Company, 1950, p. 239.

Ora Electronics Brochure, "Static Noise and Cross Talk When Using Your Portable Cellular Telephone Inside a Car?" 1990.

Ora Electronics, "Passive Repeater for Portable Cellular Telephones," 1990, 5 page publication.

dbMobile Brochure, "Active Link Repeater Installation Manual," 1992, 14 pages.

(List continued on next page.)

*Primary Examiner*—Hoanganh T. Le

*Attorney, Agent, or Firm*—Klarquist Sparkman Campbell Leigh & Whinston, LLP

[57] ABSTRACT

An active repeater assembly for in-vehicle use of personal communication devices is both simple and reliable. The assembly includes an RF amplifier coupled to first and second antennas, and is characterized by the total absence of removable coaxial connectors between the antennas and the amplifier. The outside antenna is an on-glass device, mounted on the opposite side of the same window. Oscillation is prevented by the provision of electromagnetic shielding between the inside and outside antennas.

22 Claims, 3 Drawing Sheets

U.S. PATENT DOCUMENTS

| | | | |
|---|---|---|---|
| 4,238,799 | 12/1980 | Parfitt | 343/715 |
| 4,621,243 | 4/1987 | Harada | 343/715 |
| 4,658,259 | 4/1987 | Blaese | 343/715 |
| 4,692,277 | 9/1987 | Kadokura | 343/715 |
| 4,764,773 | 8/1988 | Larsen et al. | 343/713 |
| 4,779,098 | 10/1988 | Blaese | 343/715 |
| 4,794,319 | 12/1988 | Shimazaki | 343/715 |
| 4,804,969 | 2/1989 | Blaese | 343/713 |
| 4,825,217 | 4/1989 | Choi | 343/715 |
| 4,827,275 | 5/1989 | Fusinski | 343/702 |
| 4,839,660 | 6/1989 | Hadzoglou | 343/715 |
| 4,850,035 | 7/1989 | Schiller | 455/109 |
| 4,862,183 | 8/1989 | Blaese | 343/715 |
| 4,872,630 | 10/1989 | Cooper | 248/278 |
| 5,017,934 | 5/1991 | Blaese | 343/713 |
| 5,023,622 | 6/1991 | Blaese | 343/715 |
| 5,041,838 | 8/1991 | Liimatainen et al. | 343/700 |
| 5,057,848 | 10/1991 | Rankin et al. | 343/725 |
| 5,059,971 | 10/1991 | Blaese | 343/713 |
| 5,099,252 | 3/1992 | Bryant et al. | 343/713 |
| 5,155,494 | 10/1992 | Bryant et al. | 343/713 |
| 8,829,367 | 4/1958 | Rychlik | 343/850 |

OTHER PUBLICATIONS

ATi Brochure, "ATi Repeater," 3 pages, undated, but admitted by applicant to be prior art.

Mobile Product New, "Mobile Mark–The Right Antenna," Nov./Dec. 1991, 2 page Mobile Mark advertisement.

Mobile Products International, "Mobile Mark–The Right Antenna," Winter 1991, 2 page Mobile Mark advertisement.

Cellular Business, "Is your Portable Phone a Name Dropper," Jul. 1991, 1 page Mobile Mark advertisement.

Mobile & Cellular, "If Your Future's in Cellular, we'll Help You Make Your Mark," Sep. 1991, 1 page Mobile Mark advertisement.

Cellular & Mobile International, "Your Mobile Phone Reception is as Good as Your Antenna," Spring 1991, 1 page Mobile Mark advertisement.

"The MultiPolar 2000 Pocket Passive Repeater," 2 page Antennas America, Inc. brochure, 1990.

"Valor Introduces the New PR850D; Introduces the New PR850W," 1 page Valor advertisement, undated, but admitted by applicant to be prior art.

"Dual Cell Pac Model UC850=One USA 850 and One PAC 850," 1 page Valor advertisement, undated, but admitted by applicant to be prior art.

Cellular Business, "Auden Passive Repeater Antenna," 1 page Cellelar Products, Inc. advertsiement, Jun. 1991.

Cellular Business, "The Passive Repeater: Placeo or Patsy?" Jun. 1991, pp. 50–54.

ACTIVE REPEATER ANTENNA ASSEMBLY

FIELD OF THE INVENTION

The present invention relates to antennas, and more particularly relates to active repeater antennas of the type suitable for use in vehicles and the like.

BACKGROUND AND SUMMARY OF THE INVENTION

Problems associated with use of a portable radio device within the confines of a vehicle have been known for many years. Primary among these are the shielding effects of the vehicle's metal body on transmission and reception of radio signals.

U.S. Pat. Nos. 5,099,252 and 5,155,494 to Bryant et al show a vehicle-mounted repeater that overcomes many of these problems. The patented system serves as a relay, using a first antenna positioned inside the vehicle to pick up signals transmitted, e.g., from a portable cellular telephone, and then rebroadcasting them through a second antenna positioned outside the vehicle. The system works the other way as well, receiving incoming signals using the outside antenna, and rebroadcasting them for reception by the cellular telephone inside the vehicle by using the inside antenna.

While the Bryant et al invention is particularly illustrated with reference to "passive" operation (i.e. unamplified relay of the radio signals between the inside and outside of the vehicle), the principles thereof are equally applicable to "active" repeater embodiments.

In an "active" repeater, an amplifier circuit is used to increase the strength of a signal received by one antenna before it is rebroadcast by the other. In the context of vehicle mounted active cellphone repeaters, it will be recognized that there are two signals that are being relayed (i.e. the signal transmitted by the telephone, as it is relayed for rebroadcast to the outside antenna; and the incoming signal transmitted by the telephone company, as it is relayed for rebroadcast inside the vehicle). Either or both of these signals can be amplified by an active repeater.

Vehicle-mounted active repeaters are known in the cellular telephone field, as illustrated by the MobilCell product marketed by Decibel Products, a division of the Allen Telecom Group. The MobilCell product includes a plurality of components physically distributed throughout the vehicle. One is the amplifier/repeater, which is housed in a metal box and can be positioned in the car's trunk, under a seat, or under the dash. Associated with the amplifier/repeater is a small "rubber duckie" antenna, which can be mounted directly to the amplifier/repeater unit, or can be connected through an extension cable. (The latter arrangement is apparently used if the amplifier/repeater unit is trunk-mounted, in which case the rubber duckie antenna is mounted somewhere within the passenger compartment, such as near the back seat.) A glass-mounted external antenna is then positioned outside the vehicle and connected to the amplifier/repeater unit (whatever its location) by cable.

This prior art active repeater has a number of drawbacks. One is the cost and complexity associated with having its components distributed throughout the vehicle (e.g. the amplifier/repeater in the trunk, the rubber duckie antenna near the back seat, and the external antenna mounted outside the vehicle). Further, each of these components must be connected to one or more of the other components, such as by cabling and/or connectors, which increases expense and introduces reliability concerns.

The physically distributed nature of the MobilCell system is largely dictated by oscillation concerns. In a more compact arrangement, with the antennas physically closer, the amplifier would likely oscillate. That is, the amplified signal provided by the amplifier/repeater to one antenna for rebroadcast would likely be picked up by the other antenna and fed back into the amplifier input, where it would be further amplified, etc. The amplifier/repeater unit would quickly be overloaded with its own signal and would cease working for its intended operation.

An alternative approach, adopted for example in a product marketed by ORA Electronics, is to eliminate the inside pickup antenna, and instead connect the amplifier unit to the handheld cellular telephone by coaxial cable. Such an approach, however, severely restricts the user's freedom of movement.

In accordance with the present invention, the foregoing and other drawbacks of the prior art are overcome, providing an active repeater that is both simple and reliable. In a preferred embodiment, the amplifier circuitry is disposed in a small housing mounted adjacent the inside of a vehicle window. The inside antenna is coupled to the same assembly. The outside antenna is an on-glass device, mounted on the opposite side of the same window. Oscillation is prevented by the provision of electromagnetic shielding between the inside and outside antennas. In one embodiment, the shielding takes the form of a ground plane on a double-sided circuit board, on which both the inside antenna and amplifier are formed. In another embodiment, the shielding takes the form of the car's metal body, e.g. by positioning the internal and external antennas so the vehicle's metal roof is interposed therebetween.

The foregoing and additional features and advantages of the present invention will be more readily apparent from the following detailed description, which proceeds with reference to the accompanying drawings.

DETAILED DESCRIPTION

To provide a comprehensive disclosure without unduly lengthening this specification, applicants incorporate by reference the disclosures of U.S. Pat. Nos. 2,829,367, 4,238,799, 4,658,259, 4,764,773, 5,099,252 and 5,155,494.

Figure 1:
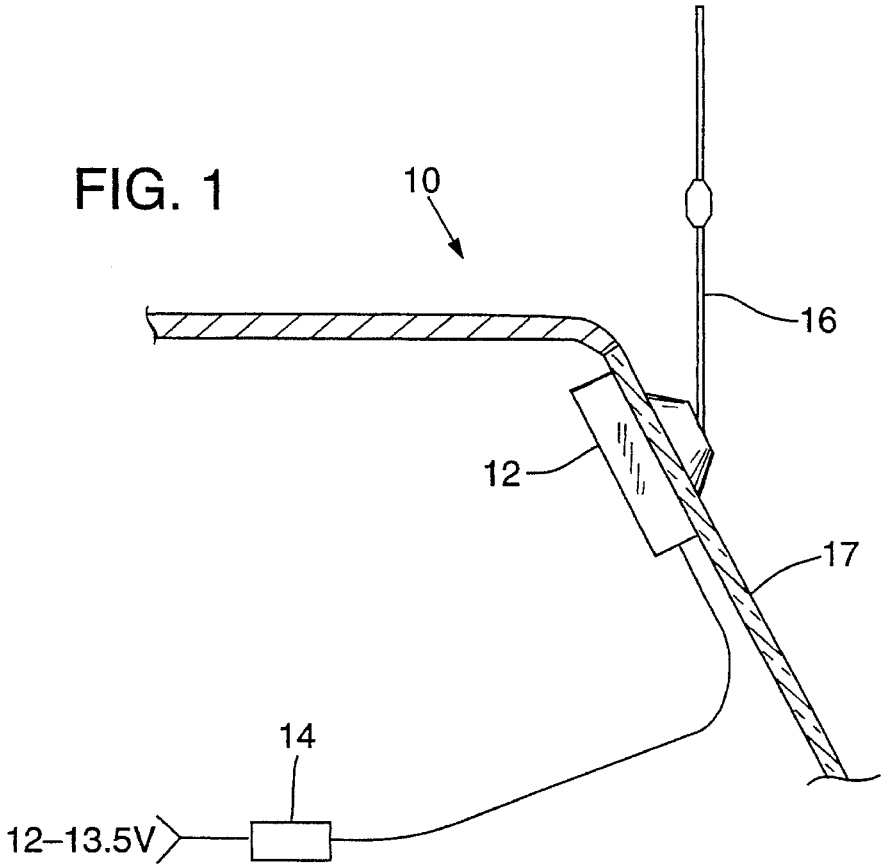
FIG. 1 is a diagram showing one embodiment of the present invention, employing an internal "patch" antenna defined on one side of a double-sided printed circuit board.

Referring to FIG. 1, an exemplary embodiment 10 of the present invention includes an active repeater unit 12, a power supply 14, an external antenna 16, and an internal antenna. (The internal antenna is not visible in FIG. 1 because it is disposed within the molded plastic housing of the active repeater unit 12.) The active repeater unit is positioned adjacent a window 17 of the vehicle by a known technique, such as an adhesive, or a mechanical clip that hangs from the top of the window.

Figure 2:
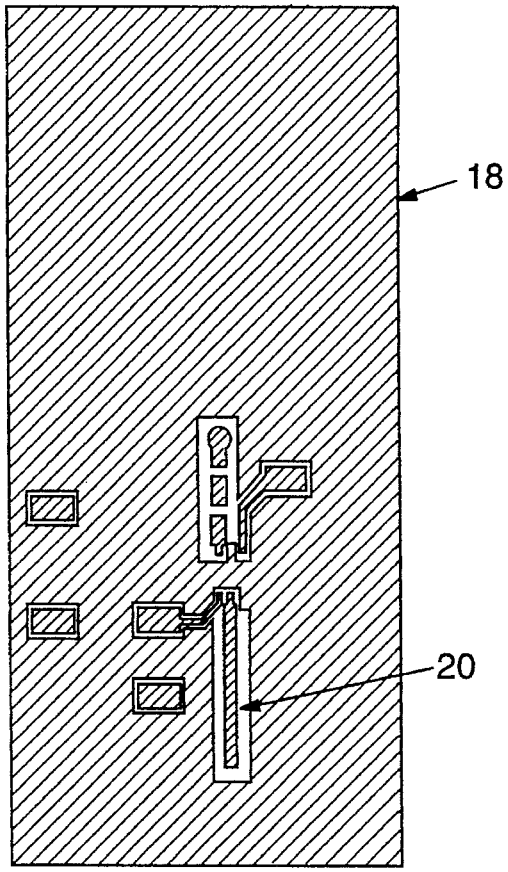
FIG. 2 is a diagram showing the etching pattern for a layer of the printed circuit board used in the FIG. 1 embodiment, particularly showing the patch antenna.

FIG. 2 shows the patterning of a printed circuit board 18 used in the active repeater unit 12. Most of the circuit board pads are for connection to electrical components that comprise the repeater. Relevant to the present discussion is a patch antenna 20 defined on the printed circuit board.

Patch antennas are known in the art, and are generally defined by a patterned copper conductor on a printed circuit board. In the illustrated embodiment, the patch antenna 20 is a quarter wavelength radiator at the cellular frequency of interest, and operates against a solid ground plane on the other side of the circuit board 18. Due to the dielectric constant of the printed circuit board material, radio waves propagate along the patch antenna more slowly than they do in free space, so the physical length of the patch is somewhat shorter than a free space quarter wavelength.

Because of the solid copper ground plane on the opposite side of the circuit board 18, antenna 20 has a directional pattern, with a null in the hemisphere bounded by the copper ground plane. This directionality permits the patch antenna 20 to be operated in close physical proximity with the outside antenna 16 without feedback problems. That is, the copper ground plane serves as electromagnetic shielding that isolates the two antennas.

While the foregoing embodiment is suitable for many applications, its utility is ultimately limited by the gain of the active repeater unit 12. At gains above some threshold level, the isolation provided by the groundplane behind the patch antenna will be insufficient to avoid oscillations. In circumstances where more gain than can be accommodated in the first embodiment is desired, a second embodiment 22 can be used.

Figure 3:
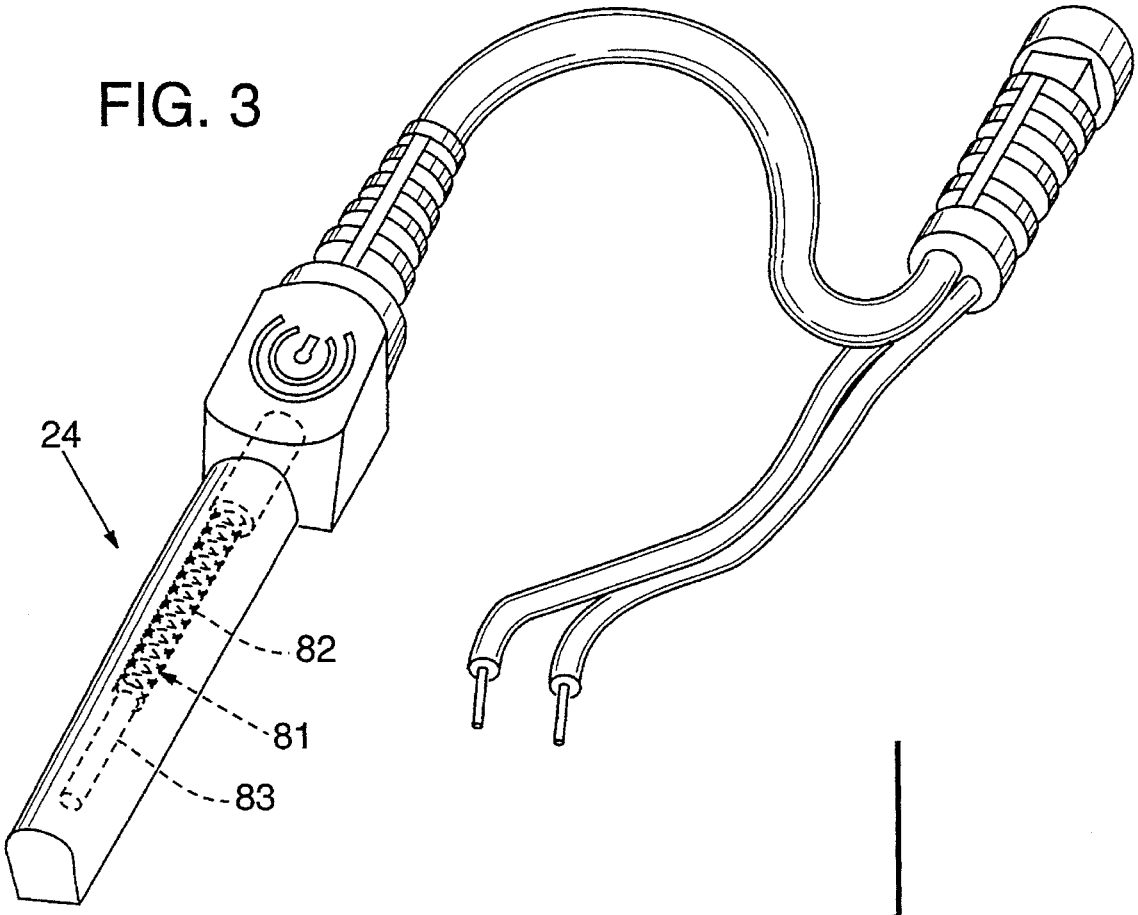
FIG. 3 is a diagram showing another embodiment of the present invention, in which the inside antenna is permanently connected to the active repeater unit through a coaxial connector.

The second embodiment 22 is shown in FIG. 3. In this embodiment, the pickup antenna 24 is not disposed within the active repeater housing itself, but instead is permanently coupled thereto through a coaxial cable 80, allowing more flexibility in its positioning. In the illustrated embodiment, the pickup antenna is a 5.5 inch coaxial cable stub 81 (RG-174/U) having the shield 82 stripped from the last 3 inches 83 thereof. This antenna is disposed within a tapered dielectric housing 84 having a length of 6 inches, and a diameter that tapers from 0.25 inch to 0.2 inch.

In this second embodiment, the internal antenna 24 is positioned by by a fastener means, such as double-sided adhesive tape, glue, Velcro®, or the like, inside the vehicle, such as concealed behind the roof liner 85 or affixed to a door post. Isolation between the inside and outside antennas 24, 16 sufficient to avoid isolation can be achieved in various ways. One is simply to space the antennas sufficiently far that free space path loss attenuates the retransmitted signal enough to avoid oscillation. Preferred, however, is to position the two antennas so that a metal member of the car, such as the roof 26 or a door post, is interposed between them. The metal member thus serves as an isolating means that blocks radiation from one antenna from reaching the other. (The degree of isolation will—of course—depend on a number of factors, including the degree by which the interposed metal shadows one antenna from another, and the refraction of radio waves around the edge of the metal member. Perfect isolation, however, isn't required; only sufficient isolation to avoid oscillation.)

Figure 4:
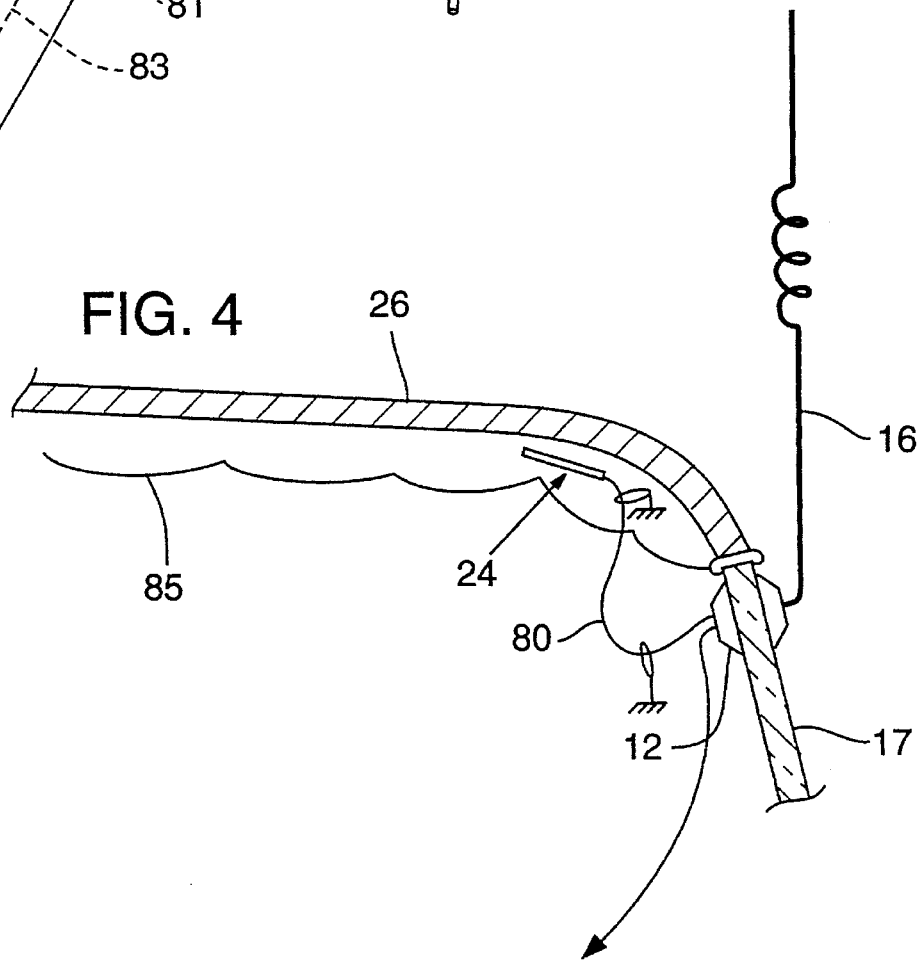
FIG. 4 is a diagram showing a typical mounting arrangement for the embodiment of FIG. 3, wherein the inside and outside antennas are isolated by a vehicle's metal roof.

FIG. 4 shows an exemplary mounting arrangement in which the pickup antenna 24 is disposed within the cloth roof liner 84 of a vehicle. As can be seen, the metal of the roof shadows over 90% of the external antenna's extent from the pickup antenna. Only a slight length at the base of the external antenna 16 is within the field of direct view of the pickup antenna.

Isolation can be further enhanced by mounting the external radiator 16 on an extension mast, by which the degree of RF shadowing afforded by the metal roof of the vehicle is increased.

It will be recognized that many such arrangements advantageously exploit the aggravating principle that prompted development of repeater antennas in the first place: the shielding effects of a vehicle's metal members.

Figure 5:
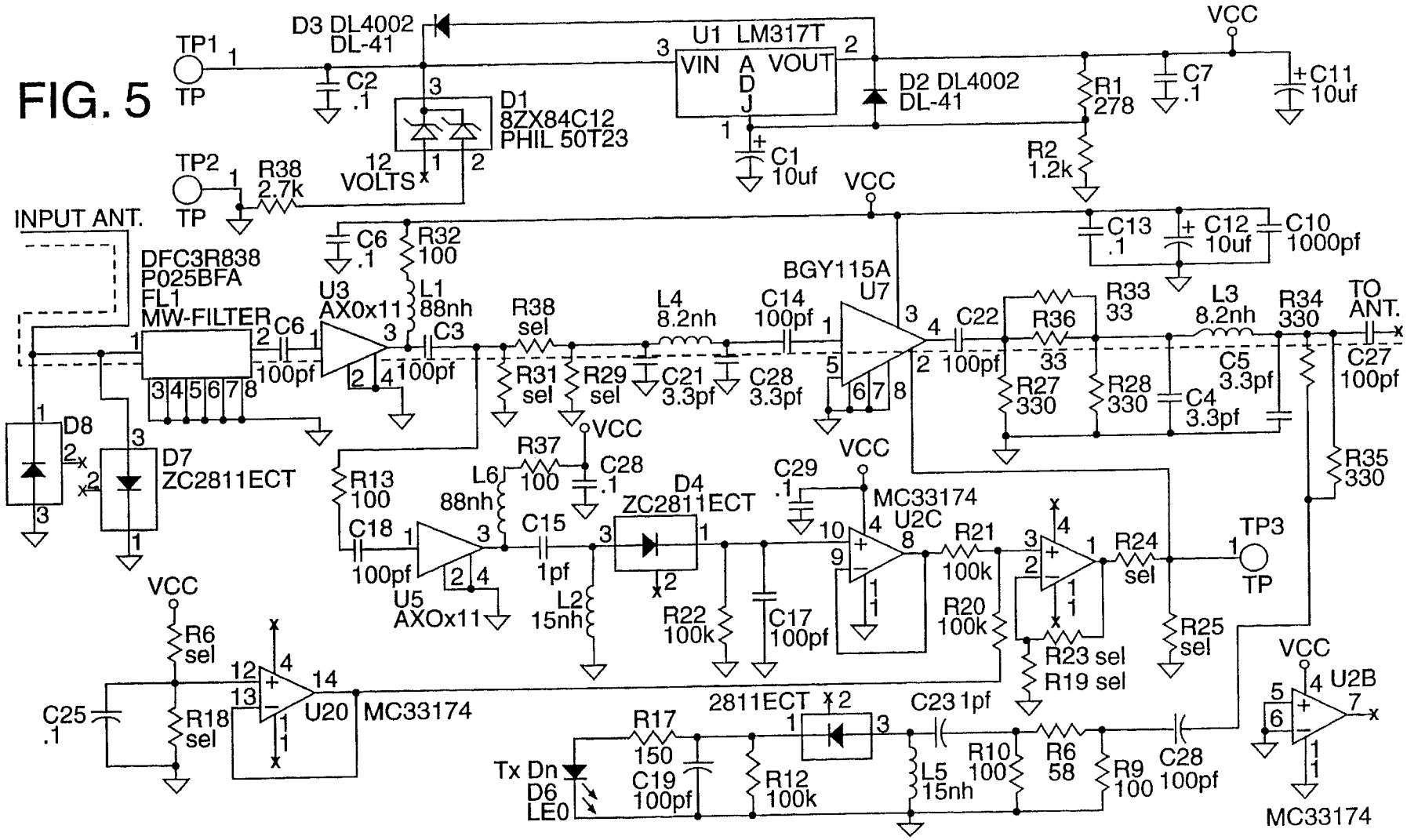
FIG. 5 details the circuitry of an active repeater used in the FIG. 3 embodiment.

FIG. 5 details the circuitry of a repeater unit 12 used in the FIG. 3 embodiment. The details thereof form no part of the present invention; any suitable RF amplifier circuit can be utilized.

The illustrated repeater unit 12 amplifies only the signal which originates from the cellular telephone in the vehicle, providing an amplified version thereof to the outside antenna 16 for rebroadcast. There is no amplification of incoming signals in the illustrated arrangement. Of course, in other embodiments, such amplification of incoming signals could be provided, if desired.

Active repeater unit 12 includes a housing 40 containing the depicted components. In at least the first embodiment 10, the housing is formed of molded plastic to permit radiation to and from the patch antenna 20 disposed within the housing. In the second embodiment 22, a shielded enclosure can be used to help avoid oscillations.

The external antenna 16 in both embodiments is conventional and may comprise, for example, the collinear phased array shown in U.S. Pat. Nos. 5,155,494 and 4,764,773. The antenna 16 can be coupled to the active repeater unit 12 by a variety of means. One is by any of a number of through-glass coupling systems. A common through-glass coupling system employs a single capacitive coupling plate on each side of the vehicle window, as shown for example in U.S. Pat. Nos. 4,658,259 and 4,238,799. Another employs a pair of coupling plates on each side of the window, as shown for example in U.S. Pat. No. 4,764,773. Yet another employs an inductive coupling member on each side of the window, as shown for example in U.S. Pat. No. 2,829,367. Still another approach is to "snake" a small coaxial cable over the window between the repeater unit and the external antenna, as shown for example in FIG. 3 of U.S. Pat. Nos. 5,155,494 and 5,099,252.

All of these coupling approaches are characterized by the total absence of removable coaxial cable connectors between the external antenna 16 and the repeater unit 12. (The term "removable coaxial connectors" is meant to refer to N, TNC, UHF, BNC, RCA phono, and other mating RF fittings that provide both physical and electrical connections, while maintaining (at least to some degree) continuous shielding of the coaxial center conductor by the coaxial shield.) Likewise, the preferred embodiments are similarly characterized by the absence of removable coaxial cable connectors between the inside antenna 24 and the active repeater unit 12. (In the first embodiment 10, the inside antenna is fabricated on the same circuit board 18 as the amplifier circuitry; in the second embodiment 22, the inside antenna is wired to the active repeater unit.) Those skilled in the art recognize that removable coaxial cable connectors are prone to reliability problems, and increase the cost/complexity of the systems with which they are used.

Some embodiments of the present invention are still further characterized by the absence of any coaxial cable between the active repeater unit 12 and either antenna.

In the illustrated embodiments, the inside and outside antennas are separated by a distance (between the closest parts of their radiating (aka "active") structures) of five feet or less (three or less in the preferred embodiments). Such close spacing cannot be achieved in prior art cellphone active repeaters known to applicants without oscillation problems.

From the foregoing, it will be recognized that the illustrated embodiments provide compact, simple active repeater systems characterized by close antenna spacing and the absence of costly, failure prone components (such as removable coaxial cable connectors, RF cable, and a separate interior antenna assembly).

Having described and illustrated the principles of our invention with reference to preferred embodiments thereof, it will be apparent that these embodiments can be modified in arrangement and detail without departing from the principles of the invention.

For example, while two different forms of electromagnetic shielding between nearby inside and outside antennas have been particularly shown, it will be recognized that such shielding can take a variety of other forms.

Similarly, while the invention has been illustrated with reference to a discrete power supply unit that provides the repeater's operating voltages, it will be recognized that such power supply circuity can alternatively be built directly into the housing of the repeater unit.

The illustration of the invention as a repeater for cellular telephone signals in the context of a vehicle should not be taken as limiting its applicability. The invention finds utility with a variety of other radio-based personal communication devices and in a variety of other physical settings as well.

In view of the wide variety of embodiments to which the principles of our invention can be applied, it should be apparent that the detailed embodiments are illustrative only and should not be taken as limiting the scope of our invention. Rather, we claim as our invention all such modifications as may come within the scope and spirit of the following claims and equivalents thereto.

We claim:

1. In an antenna assembly for use with a personal communications device in a motor vehicle, the assembly including a first antenna positioned outside the vehicle, and a second antenna coupled with the first antenna, the first and second antennas being positioned on opposing surfaces of a window or windshield of said vehicle, the assembly characterized by absence of a feedline extending completely between said antenna assembly and the personal communications device with which it is to be used, wherein a user of the personal communications device can gain benefit from the first antenna without the hindrance of a physical, wired connection extending completely between the device and the antenna assembly, an improvement comprising: an amplifier through which the second antenna is coupled to the first antenna, and a conductive body positioned between the two antennas to increase RF isolation therebetween, wherein a compact active repeater assembly is provided.

2. The antenna assembly of claim 1 in which the first and second antennas are spaced less than three feet apart.

3. The antenna assembly of claim 1 in which neither of said first nor second antennas is coupled to the amplifier through a removable coaxial cable connector.

4. The antenna assembly of claim 1 in which the conductive body comprises a ground plane on a circuit board.

5. The antenna assembly of claim 4 in which the second antenna is defined on said circuit board.

6. The antenna assembly of claim 5 in which the circuit board defines a plurality of coplanar conductive traces, and in which certain of said conductive traces define the second antenna.

7. The antenna assembly of claim 1 in which the isolation means includes means for positioning the first and second antennas relative to one another so that a roof of the vehicle blocks in excess of 90 percent of the apparent extent of the first antenna as viewed from the second antenna.

8. The antenna assembly of claim 1 in which the amplifier is mounted to a vehicle window or windshield.

9. The antenna assembly of claim 8 further characterized by the absence of a coaxial cable coupling the amplifier to the first antenna.

10. The antenna assembly of claim 1 in which the second antenna is permanently connected to the amplifier, and the first antenna is through-glass coupled to the amplifier.

11. The antenna assembly of claim 1 in which the second antenna is a stub antenna comprising a length of coaxial cable, said cable including a center conductor and a shield conductor, wherein a portion of the shield conductor has been removed to leave a portion of the center conductor unshielded.

12. The antenna assembly of claim 1 in which the second antenna is disposed in the roof liner of the vehicle.

13. The antenna assembly of claim 1 in which the second antenna is affixed to a door post of the vehicle.

14. The antenna assembly of claim 1 in which said amplifier is a one-way amplifier, amplifying only signals received by the second antenna before their provision to the first antenna.

15. The antenna assembly of claim 1 which further includes a single connector through which both the second antenna, and a power source, are coupled to the assembly.

16. The antenna assembly of claim 1 in which the conductive body comprises a metal roof of the vehicle.

17. The antenna assembly of claim 1 in which the second antenna is permanently coupled to the amplifier, rather than through a removable coaxial fitting.

18. In a method of transmitting signals using a personal communications device and a vehicle mounted antenna assembly, the personal communication device being positioned inside a vehicle, the vehicle mounted antenna assembly including an external antenna that is positioned outside the vehicle and is mounted on an exterior glass surface thereof, the antenna assembly further including an internal antenna disposed within the vehicle, the method including coupling signals from the personal communications device to the external antenna from the personal communications device through the internal antenna and thereafter via a through-glass coupling system to the external antenna, said coupling from the personal communications device being accomplished without an electrical cable extending completely between said device and the antenna assembly, and without an electrical cable extending from the external antenna to inside the vehicle, an improvement comprising:

amplifying the signal received by the internal antenna by amplifier circuitry during its coupling to the external antenna;

coupling the internal antenna permanently to the amplifier circuitry without an intervening removable coaxial cable connector;

coupling the external antenna to the amplifier circuitry without an intervening removable coaxial cable connector;

positioning the internal antenna less than three feet from the external antenna;

positioning the internal antenna and the external antenna relative to one another so that a metal member of the vehicle shadows at least 90% of the external antenna's extent as viewed from the internal antenna;

wherein a compact, simple, and reliable active repeater assembly is provided.

19. In an antenna assembly for use with a personal communications device in a motor vehicle, the assembly including a first antenna positioned outside the vehicle, and a second antenna coupled with the first antenna, the first and second antennas being adhesively positioned on opposing surfaces of a window or windshield of said vehicle, the assembly characterized by absence of a feedline extending completely between said antenna assembly and the personal communications device with which it is to be used, wherein a user of the personal communications device can gain benefit from the first antenna without the hindrance of a physical, wired connection extending completely between the device and the antenna assembly, an improvement comprising:

an amplifier through which the second antenna is coupled to the first antenna;

isolation means for positioning a conductive body between the two antennas to increase RF isolation therebetween;

and wherein the second antenna is permanently coupled to the amplifier, rather than through a removable coaxial fitting;

wherein a compact, lower cost active repeater assembly is provided.

20. The antenna assembly of claim 19 in which said amplifier is a one-way amplifier, amplifying only signals received by the second antenna before their provision to the first antenna.

21. The antenna assembly of claim 19 which further includes a single connector through which both the second antenna, and a power source, are coupled to the assembly.

22. The antenna assembly of claim 19 in which the amplifier is mounted to said vehicle window or windshield.

* * * * *